United States Patent [19]

Stick

[11] 3,953,722

[45] Apr. 27, 1976

[54] FLASHLIGHT SUPPORT MEANS

[75] Inventor: Gerald A. Stick, New Buffalo, Mich.

[73] Assignee: Danny R. Stick, New Buffalo, Mich. ; a part interest

[22] Filed: Feb. 14, 1974

[21] Appl. No.: 442,443

[52] U.S. Cl. ..... 240/6.4 W

[51] Int. Cl.[2] ..... F21V 33/00

[58] Field of Search ..... 240/6.4 R, 6.4 W, 10.6 R, 240/10.66, 52.5, 59, 60, 10 T, 10.63, 10.65, 10.67, 10.68; 200/11 R, 60, 61.58 R, 275; 339/11

[56] References Cited

UNITED STATES PATENTS

| | | | |
|---|---|---|---|
| 1,205,629 | 11/1916 | Hitzelberger | 240/10.6 R X |
| 2,265,670 | 12/1941 | Platt | 240/59 |
| 2,374,375 | 4/1945 | O'Donnell | 240/6.4 W |
| 2,389,591 | 11/1945 | Brown | 240/10.6 R |
| 2,546,945 | 3/1951 | Gaffield | 240/6.4 W |
| 3,099,399 | 7/1963 | Kibby | 240/6.4 R |
| 3,243,562 | 3/1966 | O'Brien | 200/275 X |
| 3,818,209 | 6/1974 | Roth | 240/6.4 W |
| 3,866,035 | 2/1975 | Richey | 240/6.4 W |

FOREIGN PATENTS OR APPLICATIONS

| | | | |
|---|---|---|---|
| 646,885 | 6/1937 | Germany | 240/10.66 |

*Primary Examiner*—Fred L. Braun
*Attorney, Agent, or Firm*—Walter Leuca

[57] ABSTRACT

A flashlight provided with an open electric circuit between the battery and the bulb. The spaced terminals of the open circuit extend exterior of the casing on which a safety pin type fastener is rotatably mounted. The pin bridges the terminals of the open battery circuit. The pin operates in a conventional manner to connect to any portion of an outer garment of the wearer, and when not in use, the casing is rotated to remove the safety pin from the terminals of the battery circuit thereby opening the circuit and turning off the light.

7 Claims, 5 Drawing Figures

FLASHLIGHT SUPPORT MEANS

BACKGROUND OF THE INVENTION

1. Field of the Invention

This invention relates in general to flashlights and more particularly to improvements in a flashlight casing for supporting the flashlight on an outer garment.

2. Description of the Prior Art

Due to what is now referred to as the energy crisis and the resultant attempt to conserve fuel, national legislation was passed to make daylight savings time mandatory. The effect of this is that school children are required to walk to school in darkness creating a safety hazard for the children, as well as other persons, when walking along the roadside and crossing streets. Safety precautions such as carrying conventional flashlights or reflective stickers are inadequate because of the propensity of school children to lose such items as flashlights if they are manually carried; also reflective materials depend on reflection of light and in the case of a fast moving vehicle, when the reflection is visible, the vehicle is too close to stop safely. Also the reflective sticker, to offer protection from all sides, must be attached to the wearer's outer garment on all sides thereby diminishing the attractiveness of the garment design and due to the permanent nature of the attachment to the garment, it makes the garment particularly unattractive during daylight hours when it is not needed.

SUMMARY OF THE INVENTION

Accordingly, this invention is a novel means for removably attaching a flashlight casing to any part of a wearer's outer garment, which also serves as a switch. The flashlight casing of this invention is economical to manufacture and simple to operate making this flashlight a reliable safety device for use by children. In summary, it is a battery operated light bulb supported in a plastic casing. The electric circuit between the battery and the bulb is open. The spaced terminals of the open circuit extends exterior of the casing on which a safety pin type fastener is rotatably mounted and serves to bridge the terminals of the battery circuit. The pin operates in a conventional manner to connect to any portion of the outer garment of the wearer and when not in use, the casing is rotated to remove the safety pin from the terminals of the battery circuit thereby opening the circuit and shutting the light.

Other objects and advantages will become more apparent following a more detail study of the following description read with reference to the accompanying drawing wherein a preferred embodiment of my invention is illustrated and described.

DESCRIPTION OF THE PREFERRED EMBODIMENT

Figure 1:
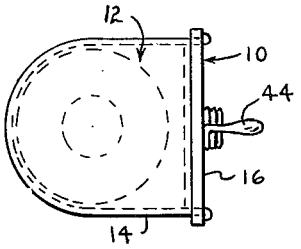
FIG. 1 is a top view of the improved flashlight of my invention.
Figure 2:
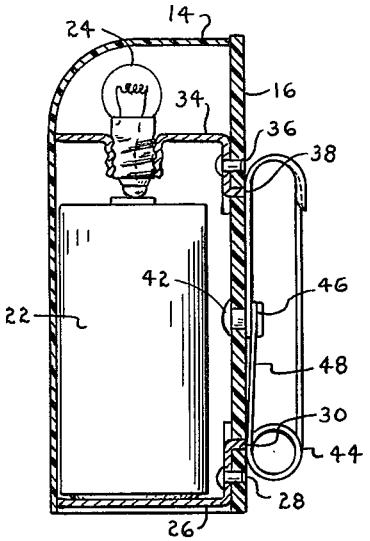
FIG. 2 is a side elevation thereof sectioned along lines 2—2 of FIG. 1.
Figure 4:
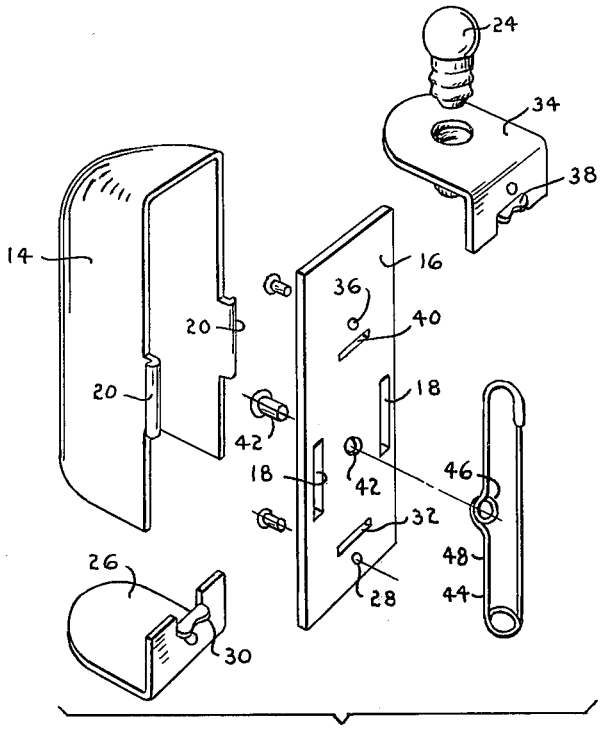
FIG. 4 is a pictorial view of the elements of this invention shown in exploded relation.
Figure 3:
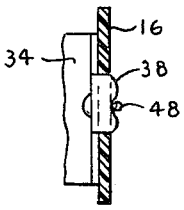
FIG. 3 is a fragment detail of the novel switch means of my invention sectioned along lines 3—3 of FIG. 2.

Referring now more particularly to the figures of the accompanying drawing, my invention is designated generally by the numeral 10. It comprises a casing 12 formed with two parts, one thereof being a hollow encapsulating member 14 preferably made from a transparent or translucent plastic material. The other member provided to form casing 12 is planular base member 16. Slotted recesses 18 are provided adjacent the sides thereof into which lip means 20, formed on the sides of encapsulating member 14, are inserted and held therein by a snap hold. So formed, encapsulating member 14 may be separable from base member 16 so that battery 22 and light bulb 24 may be replaced when necessary. I provide a current carrying strip 26 on which battery 22 rests to make current carrying contact therewith. Battery contact strip 26 is angled so that it may be connected to base member 16 as at 28 in any convenient manner and the terminal end 30 thereof biasly extends through opening or slot 32 in base member 16. Light bulb 24 is supported against the positive terminal of battery 22 by means of a current carrying bracket member 34. Bulb bracket member 34 is angled so that it may be fixed to base member 16 such as at 36 by any convenient means, and the terminal end 38 thereof is angled to biasly extend through slot 40 provided in base member 16. Slotted openings 32 and 40 are spaced from each other in opposite directions from pivot means 42 also provided in base member 16.

I further provide a garment fastening means 44 in the nature of a safety pin which is connected at 46 to pivot means 42. The terminal ends 30 and 38 of battery contact 26 and bulb bracket 34 respectively, extending through openings 32 and 40, are shaped with a slight recess to hold contact with pivot means connecting leg 48 of fastening means 44 and are biasly movable to break contact with leg 48 when flashlight casing 12 is manually rotated in either direction thereby turning off the light.

Figure 5:
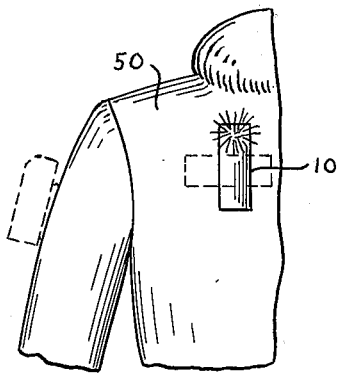
FIG. 5 is a pictorial illustration showing a portion of an outer garment, having pinned thereon the flashlight of my invention.

It is apparent that the flashlight of my invention is very effective as a safety method and means for children and for others walking in the dark because flashlight 10 may be positively secured to any portion of outer garment 50 of the wearer as shown in FIG. 5, and is put into operation simply by aligning terminals 30 and 38 of the battery circuit with pivot connecting leg 48 of fastening pin 44. when temporarily not in use, light bulb 24 is turned off by merely turning the body of casing 12 in either direction to break contact between leg 48 of pin 44 and terminals 30 and 38. Also the flashlight 10 of my invention may be easily removed from the outer garment without injury or damage thereto. The bulb 24 may be of the blinking type to attract attention. Attention is also commanded from the fact that the light will move with a jerking motion due to the gait of the wearer.

What is claimed is:

1. A switch circuit for a flashlight comprising:

a casing member for housing a light bulb and a battery;

spaced terminals on the exterior of said casing member; and a garment piercing pin pivotally mounted on said casing member between said spaced terminals, said pin being rotatable relative to said casing member to contact said spaced terminals.

2. The switch circuit of claim 1 wherein said garment piercing pin is further characterized as being a safety pin.

3. A switch circuit for a flashlight comprising:

a flashlight casing member;

spaced terminals on said flashlight casing member; and a garment piercing pin pivotally mounted on said flashlight casing member between said spaced terminals, said pin being rotatable relative to said casing to contact said spaced terminals.

4. A casing for housing a battery and light bulb comprising:

a light bulb support means in said casing;

a battery support means in said casing;

a pivot means on said casing;

said light bulb support means being electrically conducting, and a part thereof extending exterior of said casing;

said battery support means being electrically conducting, and a part thereof extending exterior of said casing spaced from said light bulb support means; and a garment piercing pin fixed to said pivot means rotatable relative to said casing to make and break contact with said spaced parts of said light support means and said battery support means.

5. The casing for housing a battery and light bulb of claim 4 wherein said garment piercing pin is further characterized as being a safety pin.

6. A casing for housing a battery and a light bulb comprising:

a light bulb support means;

a battery support means;

a planular base member and a hollow member removably connected to said base member, said hollow member formed to house a battery on said battery support means and a light bulb in said light bulb support means;

said light bulb support means being electrically conducting, and a part thereof extending exterior of said base member;

said battery support means being electrically conducting, and a part thereof extending exterior of said base member, said part of said light bulb support means and said part of said battery support means extending exterior of said base member being spaced from each other;

a garment piercing pin pivotally mounted on the exterior of said base between said spaced parts of said light bulb support means and said battery support means and being pivotable relative to said base member to electrically close the space between said parts of said light bulb support means and said battery support means.

7. The casing of claim 6 wherein said garment piercing pin is further characterized as being a safety pin.

* * * * *